US007284402B2

(12) United States Patent
Friedman et al.

(10) Patent No.: US 7,284,402 B2
(45) Date of Patent: Oct. 23, 2007

(54) SYSTEM AND PROCESS FOR SUPERPLASTIC FORMING

(75) Inventors: Peter Friedman, Ann Arbor, MI (US); Richard Allor, Livonia, MI (US); Warren Copple, Trenton, MI (US); George Luckey, Jr., Dearborn, MI (US); Chris Young, Plymouth, MI (US)

(73) Assignee: Ford Global Technologies, L.L.C., Dearborn, MI (US)

( * ) Notice: Subject to any disclaimer, the term of this patent is extended or adjusted under 35 U.S.C. 154(b) by 219 days.

(21) Appl. No.: 11/000,181

(22) Filed: Nov. 30, 2004

(65) Prior Publication Data

US 2006/0112753 A1 Jun. 1, 2006

(51) Int. Cl.
*B21D 22/10* (2006.01)
*B21D 26/02* (2006.01)

(52) U.S. Cl. ..... 72/60; 72/57; 72/342.96; 72/364; 72/709; 425/526

(58) Field of Classification Search ..... 72/57, 72/60, 61, 62, 342.96, 364; 425/526
See application file for complete search history.

(56) References Cited

U.S. PATENT DOCUMENTS

| | | | | |
|---|---|---|---|---|
| 3,340,101 | A | 9/1967 | Fields, Jr. et al. | |
| 5,016,805 | A | 5/1991 | Cadwell | |
| 5,113,681 | A | 5/1992 | Guesnon et al. | |
| 5,410,132 | A | 4/1995 | Gregg et al. | |
| 5,974,847 | A | 11/1999 | Saunders et al. | |
| 6,087,640 | A | 7/2000 | Gillespie et al. | |
| 6,241,939 | B1 * | 6/2001 | Takada et al. | 425/526 |
| 6,253,588 | B1 * | 7/2001 | Rashid et al. | 72/57 |
| 6,457,342 | B2 * | 10/2002 | Tanahashi et al. | 72/364 |
| 6,581,428 | B1 | 6/2003 | Friedman | |
| 6,613,164 | B2 * | 9/2003 | Dykstra et al. | 72/62 |
| 6,640,878 | B2 | 11/2003 | Allor et al. | |
| 6,648,053 | B2 | 11/2003 | Allor et al. | |
| 7,028,519 | B2 * | 4/2006 | Kim et al. | 72/60 |
| 7,112,249 | B2 * | 9/2006 | Schroth et al. | 72/57 |
| 2004/0069038 | A1 | 4/2004 | Brinas et al. | |

FOREIGN PATENT DOCUMENTS

| | | |
|---|---|---|
| JP | 62104635 | 5/1987 |
| JP | 2001129617 | 5/2001 |

* cited by examiner

*Primary Examiner*—David B Jones
(74) *Attorney, Agent, or Firm*—Raymond L. Coppielle; Tung & Associates

(57) ABSTRACT

A system and method for superplastic forming a workpiece. The system includes a superplastic forming cell formed of a plurality of individual stations or modules, each one performing a specific manufacturing step or process on the workpiece. Individual stations include a preheat station, a forming station, a cooling station, a cleaning station and a trimming station. These stations work in conjunction with one another to reduce superplastic forming cycle times and correspondingly increased production times when manufacturing a workpiece using a superplastic forming process.

18 Claims, 3 Drawing Sheets

SYSTEM AND PROCESS FOR SUPERPLASTIC FORMING

CROSS-REFERENCE TO RELATED APPLICATIONS

Not Applicable

BACKGROUND OF THE INVENTION

1. Field of the Invention

The present invention relates generally to a system and method for superplastic forming a workpiece; and, more specifically, to an automated system including a plurality of modules forming a superplastic forming cell.

2. Description of Related Art

Superplastic forming (SPF) takes advantage of a material's superplasticity or ability to be strained past its rupture point under certain elevated temperature conditions. Superplasticity in metals is defined by very high tensile elongations, ranging from two hundred to several thousand percent. Superplasticity is the ability of certain materials to undergo extreme elongation at the proper temperature and strain rate. SPF is a process used to produce parts that are difficult to form using conventional fabrication techniques.

SPF typically includes the steps of heating a sheet of material to a point of superplasticity, clamping the material within a sealed die and then using inert gas pressure applied to one side of the sheet of material to force the material to stretch and take the shape of the die cavity. Accordingly, SPF takes advantage of certain material characteristics, specifically increased elongation at higher temperatures or the ability to stretch a material by several times its initial length without breaking.

Standard SPF applications have advantages over conventional stamping techniques, including increased forming strains, reduced spring back and low tooling costs; however, they have disadvantages in that they are limited to low volumes as they normally require relatively long forming cycle times. Specifically, a conventional SPF processes used to manufacture a complex part can require a forming cycle time as high as 30 minutes.

Further, conventional SPF systems require that the forming die is cooled prior to removal. Once cooled the die is removed a new room temperature die is inserted into the press. Before production can resume, the new room temperature die must be heated to suitable SPF temperature. This causes a significant loss of production time and cooling down and heating up of the dies. Cool down and heat up can take anywhere from 24 to 48 hours each.

Reduced cycle times are necessary in order to use SPF for the high production requirements of the automotive industry. Accordingly, there is a need for a superplastic forming system that decreases cycle time and correspondingly increases production volume.

SUMMARY OF THE INVENTION

The present invention is a system and method for raising the production volume of a superplastic forming process. The system including a superplastic forming cell used to form a workpiece. The forming cell includes a plurality of individual stations or modules, each one performing a specific manufacturing step or process on the workpiece. A plurality of transfer devices, positioned adjacent the individual stations or modules move the workpiece from one station to another.

The present invention further provides a method for forming a workpiece using a superplastic forming process. The method includes the steps of heating the workpiece, providing a forming die, placing the heated workpiece in the forming die, performing a superplastic forming process on the workpiece. Upon completion of the forming process, the method further includes the steps of removing the workpiece from the forming die, providing a cooling station and cooling the workpiece, providing a cleaning station and cleaning the workpiece and providing a trimming station and trimming the workpiece. The steps are typically performed individually; however, they may be performed or combined into a lesser amount of steps. The method further includes the steps of applying a lubricant to the workpiece prior to the forming step and providing an inspection station and inspecting the workpiece.

The present invention also provides a method and apparatus for installing and removing a heated forming die from the forming press. The method includes placing a heated forming die at a loading station, inserting the heated forming die into the forming press and clamping the forming die within the forming press. The method and apparatus further allows removal of a heated forming die in a reverse order, by unclamping the forming die within the forming press and withdrawing or pulling the heated forming die from the forming press to a loading station. Thus, the heated forming die is removed and a new preheated forming die may be installed.

DETAILED DESCRIPTION OF THE PREFERRED EMBODIMENTS

Figure 1:
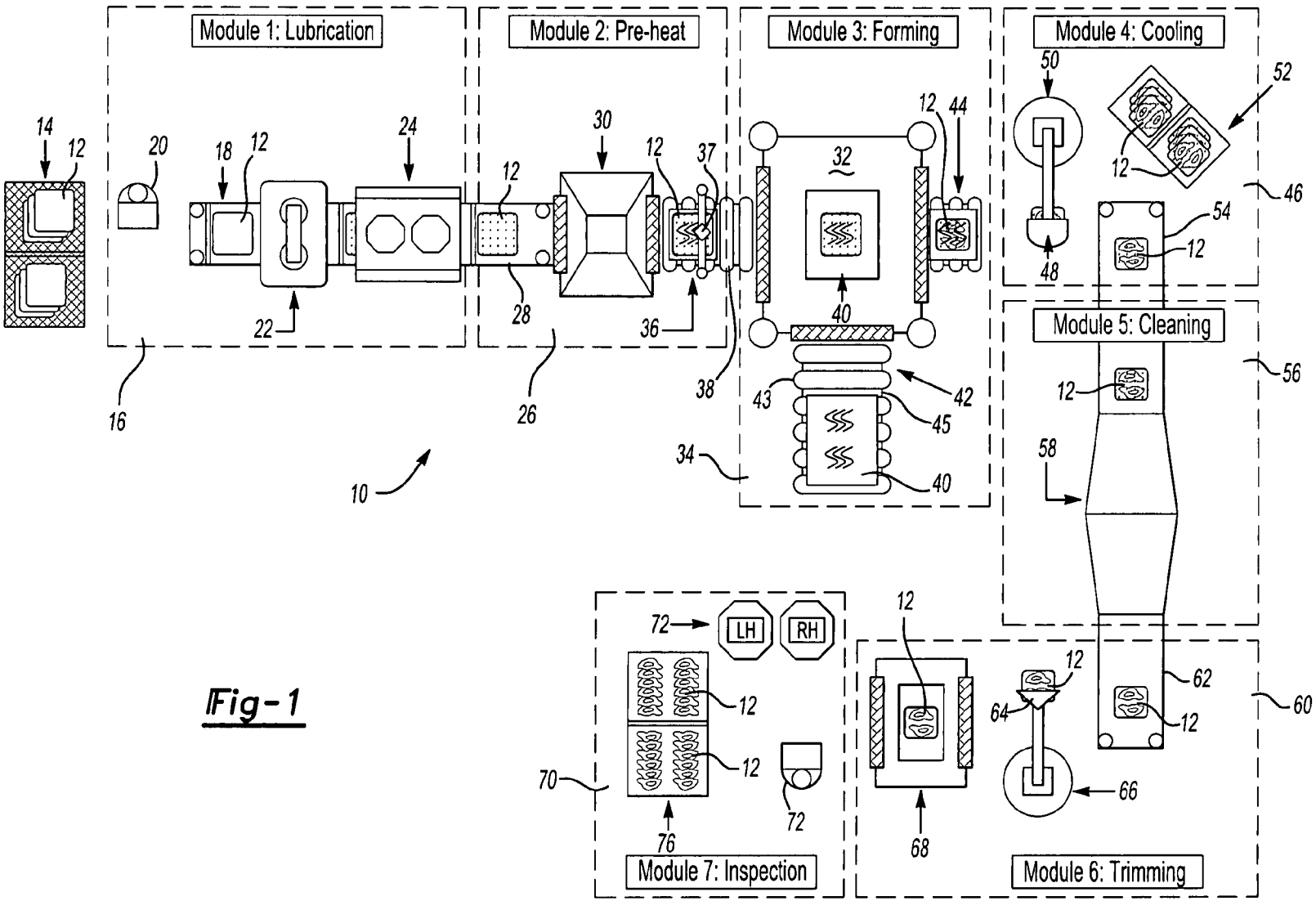
FIG. 1 is schematic diagram showing a system for superplastic forming of a workpiece.

FIG. 1 shows a superplastic forming cell, seen generally at 10, according to the present invention in schematic form. A plurality of individual stations or modules makes up the superplastic forming cell 10. The stations or modules cooperate or work together as part of an overall forming procedure or process that takes advantage of a material's superplasticity at elevated temperatures to form a workpiece 12. The procedure or process utilizes of a level of automation that retains the low-investment features of superplastic forming but significantly increases line speed and production volumes.

A plurality of workpieces 12, normally located or stored on a rack 14, is placed nearby the superplastic forming cell 10. The workpieces 12 are typically flat sheets of metal or as they are commonly referred to blanks. In the first or lubrication module 16, an operator, seen generally at 20, using manual labor, or in the alternative a type of robot or machine, lifts a workpiece 12 from the rack 14 and places it on the conveyor 18. The conveyor 18 transports the workpiece 12 to a lubrication dispenser 22.

As with other forming operations, it is important to minimize frictional effects between the workpiece 12 or blank and the die surface. Oil-based or waxy lubricants, typically used in conventional stamping operations, cannot withstand the high forming temperatures associated with superplastic forming. Accordingly, a solid lubricant, such as graphite or boron nitride, is often used in superplastic forming because of its ability to withstand the high temperature environment.

The lubrication dispenser 22 applies lubricant to the workpiece 12 using any of several known procedures, including a roll coater or a spray booth. A dryer 24 dries the lubricant so it remains on the workpiece 12. Depending upon the type of lubricant used, a dryer 24 may not be necessary. Further, given that various types of lubricants exist that are suitable for use with superplastic forming, various lubrication dispensers or processes for applying a lubricant to the workpiece 12 are also suitable for use with the present invention.

In the second or preheat module 26, a conveyor 28 transfers the lubricated workpiece 12 from the dryer 24 to a pre-heater 30. Preheating the workpiece 12 helps to reduce overall part-to-part cycle time. Thus, a preheated workpiece 12 is loaded into a superplastic forming press 32, that forms a part of the third or forming module 34. This is in contrast to conventional superplastic forming processes where a room temperature workpiece is loaded into the forming press and which delays the forming process until the workpiece reaches a predetermined or target forming temperature. Different types of pre-heaters 30 such as conduction, induction or convection heaters are suitable for preheating the workpiece 12. One type of pre-heater 28 suitable for use with the present invention is a contact heater where the workpiece 12 is sandwiched between two heated platens that transfer heat to the workpiece 12 by conduction. A shuttle system 36, which may include a conveyor 38, transfers the heated workpiece from the pre-heater 30 to the forming press 32. One example of a pre-heater and shuttle system for use with a superplastic forming process of the present invention is disclosed in co-pending application Ser. No. 11/000,186 now U.S. Pat. No. 7,199,334 B2.

The preheat module 26 may also include a temperature monitor such as a duel wavelength infrared camera 37. The infrared camera 37 monitors the workpiece 12 temperature when it exits the pre-heater 28 and prior to being transferred into the forming press 32. The infrared camera 37 is mounted over the shuttle system 36 such that as the shuttle system 36 transfers the preheated or hot workpiece 12 into the forming press 32, the workpiece 12 passes under the camera 37 which detects the surface temperature of the workpiece 12. The workpiece 12 temperature data is recorded by a computer data acquisition system and is processed to produce a two dimensional map of the surface temperature of the workpiece 12. The surface temperature map may be shown visually on a computer screen using color to identify the temperatures. This monitoring system helps to ensure good process control and can help quickly identify any issues related to pre-heating of the workpiece 12, such as low temperature or temperature inhomogeneity throughout the sheet. Additionally, the system can be used for closed-loop control over workpiece 12 temperatures.

In the third or forming module 34, the conveyor 38 transfers the preheated workpiece 12 from the preheat module 26 to the forming module 34. A forming die 40 located in the forming press 32 receives and forms the workpiece 12. A removal system 44 operates to remove the formed workpiece 12 from the forming press 32.

The forming press 32 is suitable for use with a plurality of forming dies 40. It is advantageous to change the forming dies 40 such that a preheated or hot forming die is installed in the forming press 32. Accordingly, to change or install a preheated forming die 40 in the forming press 32, the preheated forming die 40 is placed on or at a loading station 42 located adjacent the forming press 32. The loading station 42 includes a plurality of a rollers 43 secured to a load table 45. The loading station 42 may be sized such that it supports or holds more than one forming die 40. Specifically, the loading station 42 may support both the forming die 40 being removed from the forming press 32 and the new or preheated forming die 40 ready for insertion into the forming press 32.

Figure 4:
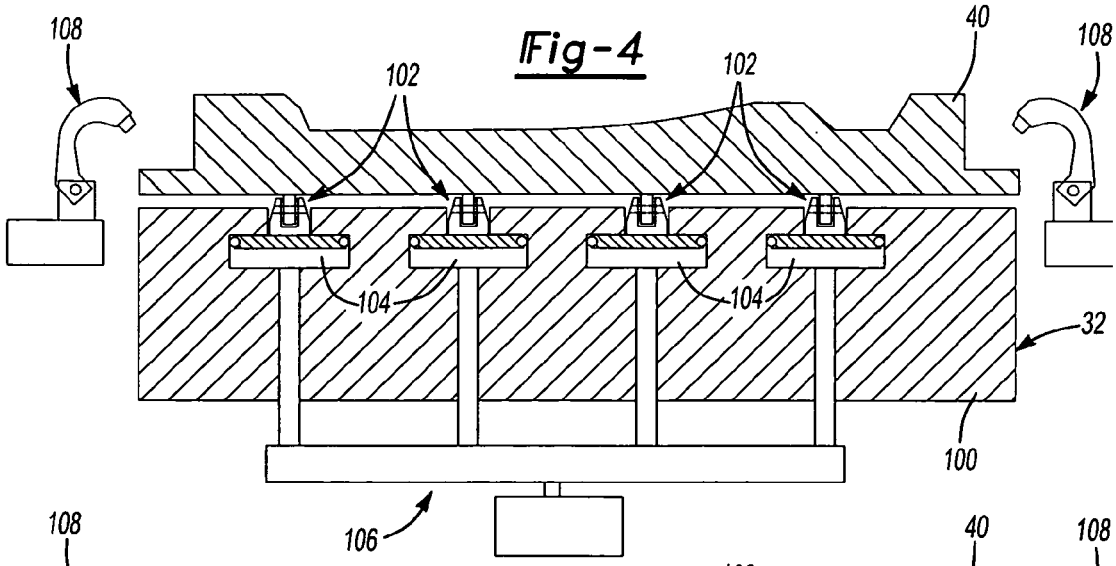
FIG. 4 is a cross sectional schematic side view illustrating an apparatus for moving a forming die into and out of a forming press.
Figure 5:
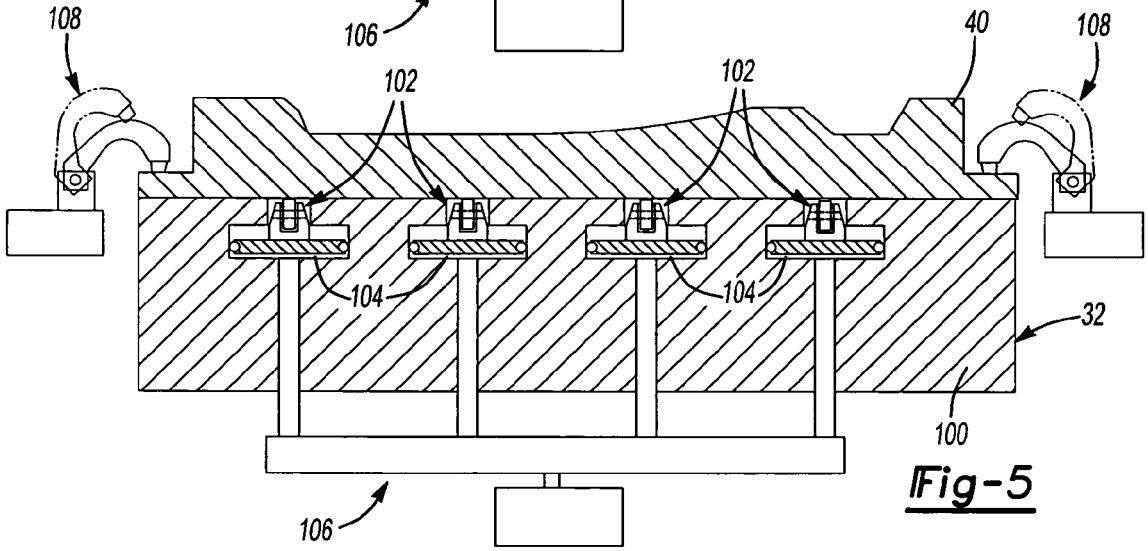
FIG. 5 is a cross sectional schematic side view of the apparatus of FIG. 4 illustrating the forming die secured to the lower platen of the forming press.
Figure 6:
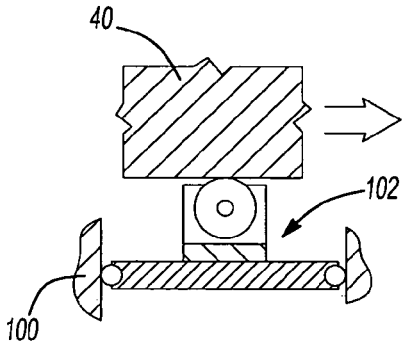
FIG. 6 is a cross sectional view of a roller assembly of the apparatus set forth in FIG. 4.

As shown in FIGS. 4-7 the forming press 32 includes a plurality of rollers 102 secured within T-slots 104 of the lower platen 100. The rollers 102 allow the forming die 42 roll into and out of the forming press 32. The rollers 102 are secured within the T-slots 104 of the lower platen 100 in a manner such that they can be raised when the forming die 40 needs to be changed. As shown in FIGS. 4-6, this is accomplished by a pneumatic or hydraulic system, seen generally at 106. Once the forming die 40 is in position within the forming press 32, the rollers 102 are lowered into the T-slots 104 whereby the forming die 40 is secured to the lower platen 100.

Die clamps, seen generally at 108, secure the forming die 40 to the lower platen 100. The die clamps 108 are shown as swing-in die clamps situated within the forming press 32 and connected to a power source or driver for remote actuation. The actuation can be accomplished by a simple mechanical connection that enables movement of the die clamps 108 from outside of the heated area of the forming press 40. Further, it is contemplated that other power sources may be used to actuate the die clamps 108, including use of the hydraulic power of the press 32 to actuate the die clamps 108.

Figure 7:
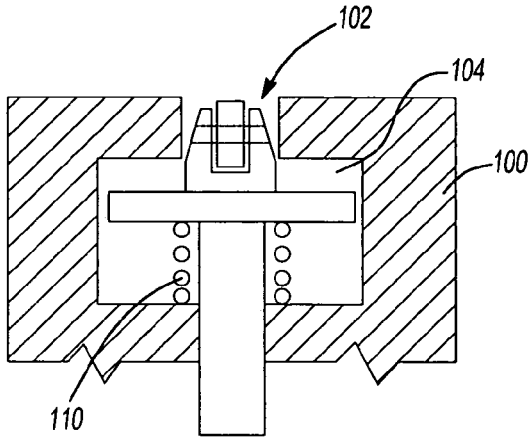
FIG. 7 is an alternative embodiment of a roller assembly of the apparatus set forth in FIG. 4.

FIG. 7 illustrates an alternative embodiment of the rollers 102 utilizing a spring 110 that urges the roller 102 upward. The combined spring force of the rollers 102 is sufficient to lift the forming die 40 off the upper surface of the lower platen 100. Accordingly, the springs 110 hold the forming die 40 off the lower platen 100 during installation and removal of the forming die 40. When the forming die 40 is placed in the proper position within the forming press 32 the die clamps 108 are actuated such that they engage the forming die 40 with sufficient force to overcome the spring force exerted by the springs 110 and secure the forming die 40 in the proper position within the forming press 32. It should be understood that other mechanisms may be used to install and remove a heated forming die 40 from the forming press 32.

Accordingly, the present invention includes a method for changing a hot forming die 40. Specifically, a preheated forming die 40 is placed on or at a load station 42. The preheated die 40 is then inserted and properly secured within the forming press 32. Inserting a preheated forming die 40 into the forming press 32 significantly reduces the loss of production time resulting from having to heat the forming die 42 within the forming press 32. In addition, being able to remove a heated forming die 40 from the forming press 32 reduces the loss of production time resulting from having to wait for the forming die 42 cool to a suitable temperature at which it can be removed from the forming press 32.

In the fourth or cooling module 46, a part extractor 48, which may include a robot 50, operates to transfer the formed workpiece 12 from the forming press 32 to different locations depending upon the particular workpiece 12 and processing parameters. In one instance or path, the workpiece 12 is placed on a cooling rack 52 for a suitable period until the workpiece 12 cools to a predetermined temperature. The robot 50 then transfers the workpiece 12 from the cooling rack 52 to a conveyor 54 that transports the workpiece 12 to the fifth or cleaning module 56. The term rack as used throughout is generic and means any type of storage structure or means for holding or storing the workpieces including placing the workpieces on the floor or on a pallet. In the second instance or path, the robot 50 transfers the workpiece 12 directly to the conveyor 54, which transports the workpiece 12 to the cleaning module 56. Depending upon the particular processing parameters used with the workpiece 12, the workpiece 12 may cool sufficiently on the conveyor 54. In addition, the cleaning module 56 may provide a mechanism to perform any necessary cooling prior to cleaning the workpiece 12.

In the fifth or cleaning module 56, a cleaning mechanism 58, including a throughput cleaning/washing system, cleans the workpiece 12 after the workpiece 12 cools. Various types of cleaning or washing systems are available for cleaning the workpiece 12; these include those using spray nozzles or brushes.

It in the sixth or trimming module, a conveyor 62 transports the workpiece 12 from the cleaning mechanism 58. A material handler 64 connected to a robot 66 is used to transfer the workpiece 12 from the conveyor 62 to a trim press 68 that trims the excess material from the workpiece 12. An automatic or manually operated trim press 68 performs the trim operation. Depending upon the volume, various ways exist to trim the workpiece 12. For low volumes, a flexible system such as a CNC or laser is used. For increased volumes, press-action trimming is used.

In the seventh or inspection module 70 an operator 72, utilizing inspection fixtures 74, inspects the workpieces 12 for part geometry and surface finish. Once inspected, the finished workpiece 12 is placed on a rack 76 for transfer to its ultimate destination.

Accordingly, a superplastic forming cell 10 including a plurality of individual modules, that cooperate or work together as part of an overall forming procedure, used to form a workpiece. The present invention links together these modules and in addition, provides a method for superplastic forming a workplace in an efficiently and expeditiously manner. While disclosed herein as including seven distinct modules, this is for illustration purposes only, the superplastic cell 10 may include a lesser or greater amount or several modules may be combined together.

Figure 2:
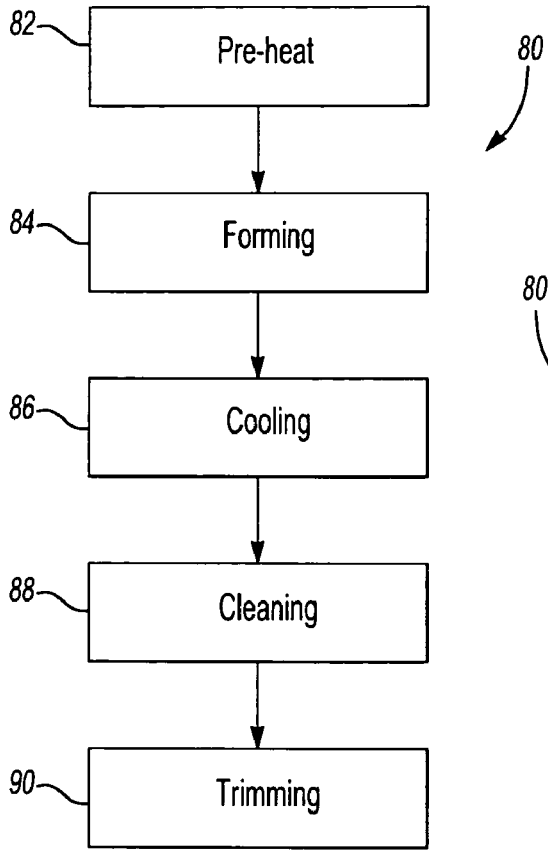
FIG. 2 is a flowchart illustrating a method for superplastic forming of a workpiece.

FIG. 2 illustrates a block diagram of one embodiment of a method 80 for superplastic forming a workpiece. The method 80 begins with block 82 wherein the workpiece is preheated prior to the forming process. Block 84 then forms the preheated workpiece, typically through use of a forming die and a superplastic forming process, including application of an inert gas to one side of the workpiece to force the workpiece to stretch and take the shape of a die cavity. Block 86 is a cooling step wherein the previously formed workpiece cools, prior to further processing. Block 88 is a cleaning step, wherein a suitable apparatus, such as a conventional cleaning/washing system, cleans the workpiece. Finally, block 90 is a trimming step wherein the cleaned workpiece is trimmed.

Figure 3:
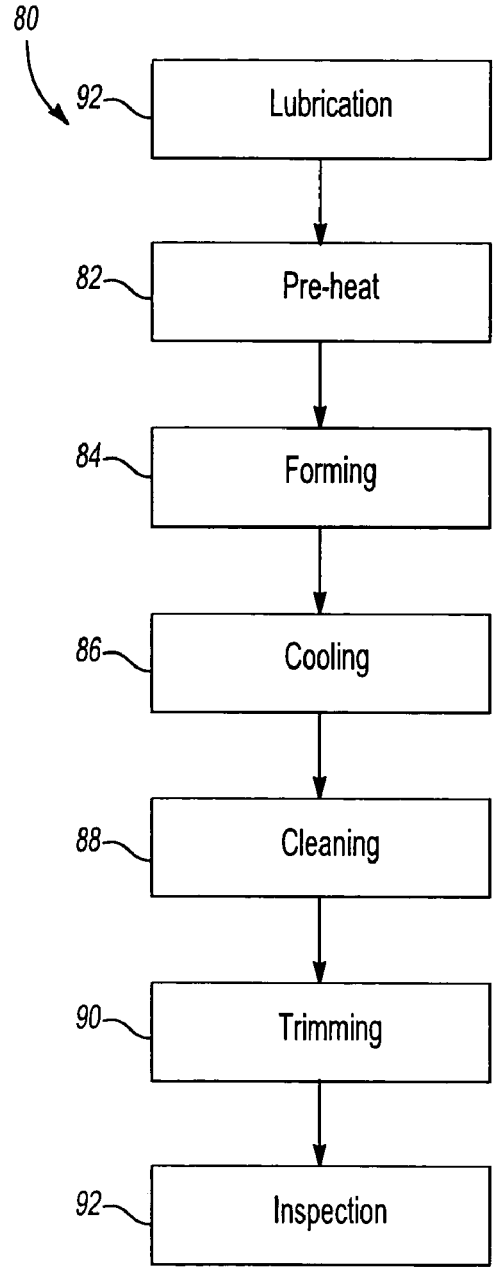
FIG. 3 is a flowchart illustrating a method for superplastic forming of a workpiece according to a further embodiment of the invention.

FIG. 3 is a block diagram that illustrates a further embodiment of a method according to the present invention and includes block 92, which is a lubrication step, wherein a lubricant is applied to the workpiece prior to the step of pre-heating the workpiece. In addition, block 94 is an inspection step wherein the parts are inspected for both part geometry and surface finish.

The overall method of the present invention provides a plurality of steps for raising the production volume for superplastic forming. These steps provide an efficient method for reducing the overall forming or cycle times necessary in order for a superplastic forming process to attain the high production requirements of the automotive or other high volume manufacturing industry.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A forming system for forming a workpiece comprising:
   - a preheat station, said preheat station including a heater for heating the workpiece to a superplastic forming temperature;
   - a forming station, said forming station including a forming apparatus having a press assembly and a forming die;
   - a shuttle mechanism, said shuttle mechanism transferring the workpiece from said heater to said forming apparatus;
   - a part extractor, said part extractor extracting said workpiece from said forming die; and
   - an infrared temperature monitor that monitors the temperature of the workpiece, said temperature monitor positioned between said preheat station and said forming station to monitor a surface temperature of the workpiece.

2. A forming system for forming a workpiece as set forth in claim 1 including:
   - a trimming station, said trim station including a trim press; and
   - a material handler, said material handler transferring the workpiece from said cleaning station to said trim press.

3. A forming system for forming a workpiece as set forth in claim 2 including:
   - an inspection station, said inspection station including an inspection fixture; and
   - a rack, said rack storing inspected workpieces.

4. A forming system for forming a workpiece as set forth in claim 1 including:
   - a lubrication station, said lubrication station including a lubrication dispenser.

5. A forming system for forming a workpiece as set forth in claim 4 including:
   - a trimming station, said trimming station including a trim press; and
   - a material handler, said material handler transferring the workpiece from said cleaning station to said trim press.

6. A forming system for forming a workpiece as set forth in claim 5 including:
   - an inspection station, said inspection station including an inspection fixture; and
   - a rack, said rack storing inspected workpieces.

7. A forming system for forming a workpiece as set forth in claim 6 including:

a cooling station, said cooling station including a rack; and said part extractor transferring the workpiece from said forming die to said rack.

8. A forming system for forming a workpiece as set forth in claim 1 including:

a die changeover mechanism, said die changeover mechanism located adjacent said press assembly and operative to transfer said forming die in to and out of said press assembly, said that die changeover mechanism including a plurality of rollers located in a lower platen of said press assembly and a plurality of die clamps to operative to clamp said forming die to said lower platen of said press assembly.

9. A method for superplastic forming a workpiece comprising:

providing a preheat apparatus;

heating the workpiece with the preheat apparatus to a superplastic temperature forming range;

providing a superplastic forming apparatus, including a forming die;

transferring the heated workpiece from the preheat apparatus to the forming die;

measuring the temperature of the heated workpiece when the heated workpiece is transferred from the preheat apparatus to the forming die to ensure that the workpiece is within the superplastic temperature forming range;

superplastic forming the workpiece, including producing a pressure differential between a first and a second side of the workpiece, the pressure differential causing the workpiece to take the shape of a forming surface of the forming die; and extracting the workpiece from the superplastic forming apparatus.

10. A method for superplastic forming a workpiece as set forth in claim 9 including the steps of:

cooling the workpiece for a suitable period after extracting the workpiece from the superplastic forming apparatus;

cleaning the workpiece once the workpiece has cooled sufficiently; and trimming the workpiece.

11. A method for superplastic forming a workpiece as set forth in claim 10 including the step of:

applying a lubricant to the workpiece.

12. A method for superplastic forming a workpiece as set forth in claim 11 including the step of:

inspecting the workpiece after the workpiece is trimmed.

13. A method for superplastic forming a workpiece as set forth in claim 9 including the steps of:

applying a lubricant to the workpiece prior to the step of heating the workpiece;

cooling the workpiece for a suitable period after extracting the workpiece from the superplastic forming apparatus;

cleaning the workpiece after the workpiece has cooled sufficiently;

trimming the workpiece; and inspecting the workpiece after the workpiece is trimmed.

14. A method for superplastic forming a workpiece as set forth in claim 11 wherein the step of applying a lubricant includes the steps of:

providing a lubricant dispenser, using the lubricant dispenser to apply the lubricant to the workpiece;

providing a dryer, using the dryer to dry the lubricant whereby it stays on the workpiece.

15. An apparatus for superplastic forming a workpiece comprising:

a heater, said heater operative to receive and heat said workpiece to a superplastic forming temperature;

a forming station including a press assembly and a forming die, said forming die having a forming surface;

a shuttle assembly, said shuttle assembly operative to transfer the workpiece from said heater to said forming die;

a forming die changeover mechanism, said forming die changeover mechanism located adjacent said press assembly and operative to transfer said forming die in to and out of said press assembly;

a cooling station;

a part extractor, said part extractor operative to remove the workpiece from said forming die and transfer the workpiece to said cooling station;

a cleaning mechanism; said part extractor operative to transfer the workpiece from said cooling station to said cleaning mechanism;

a trim apparatus; and a material handler operative to transfer the workpiece from the cleaning mechanism to said trim apparatus.

16. An apparatus for superplastic forming a workpiece as set forth in claim 15 including:

a lubrication dispenser, said lubrication dispenser operative to apply a lubricant to the workpiece.

17. An apparatus for superplastic forming a workpiece as set forth in claim 16 including:

a dryer, said dryer positioned adjacent said the lubricant dispenser.

18. An apparatus for superplastic forming a workpiece as set forth in claim 15 including:

a temperature monitor that detects the temperature of the workpiece.

* * * * *